United States Patent [19]

Warenback

[11] 4,062,138

[45] Dec. 13, 1977

[54] CARD FORMING PEDESTAL DISPLAY DEVICE

[76] Inventor: Melvin S. Warenback, 595 Las Colindas Road, San Rafael, Calif. 94903

[21] Appl. No.: 687,295

[22] Filed: May 17, 1976

[51] Int. Cl.[2] ..... G09F 1/00

[52] U.S. Cl. ..... 40/124.1

[58] Field of Search ..... 46/157; 40/124.1, 126 A

[56] References Cited

U.S. PATENT DOCUMENTS

| | | | |
|---|---|---|---|
| 1,236,253 | 8/1917 | Bickerstaff | 40/124.1 |
| 1,285,037 | 11/1918 | Chance | 46/157 |
| 3,280,492 | 10/1966 | Nichols | 40/124.1 X |

*Primary Examiner*—Louis G. Mancene
*Assistant Examiner*—Wenceslao J. Contreras
*Attorney, Agent, or Firm*—David B. Harrison

[57] ABSTRACT

A four edged single sheet card formable into pedestal supported display is disclosed. A single thickness of sheet material of suitable shape is provided with a predetermined pattern of cuts and fold lines. These cuts and lines define a top portion including a label section, a transverse opening, and a top tab, the label section being joined to the top tab along a first transverse fold line. A left section is connected to the top portion along a second transverse fold line and extends downwardly therefrom along the left edge of the card. A left transverse crease line divides the left section into at least two vertically arranged segments. A right section is connected to the top portion and the second fold line, and extends downwardly therefrom along the right edge of the card. A right transverse crease line divides the right section into at least two vertically arranged segments each of which substantially corresponds to a similarly located segment of the left section. A display section is located between the left and right sections and below the top portion of said card and is disconnectable therefrom. A bottom portion of the card at the bottom of, and rigidly integral with, the display section, provides a bottom tab with left and right lateral portions extending outwardly beyond the display section, the left lateral portion being hinged to the left section, and the right portion being hinged to the right section along an eighth crease line. The card may be formed into the pedestal display by separation of the display portion, outward folds along all of the crease lines, positioning of the label section adjacently below the display section to form the display and interlocking of the display by insertion of the bottom tab through the transverse opening in the top portion.

14 Claims, 25 Drawing Figures

FIG. 1
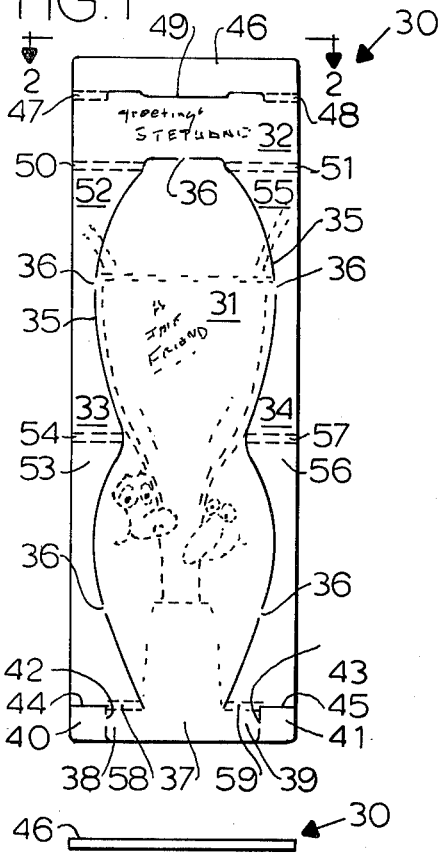
FIG. 2
FIG. 3
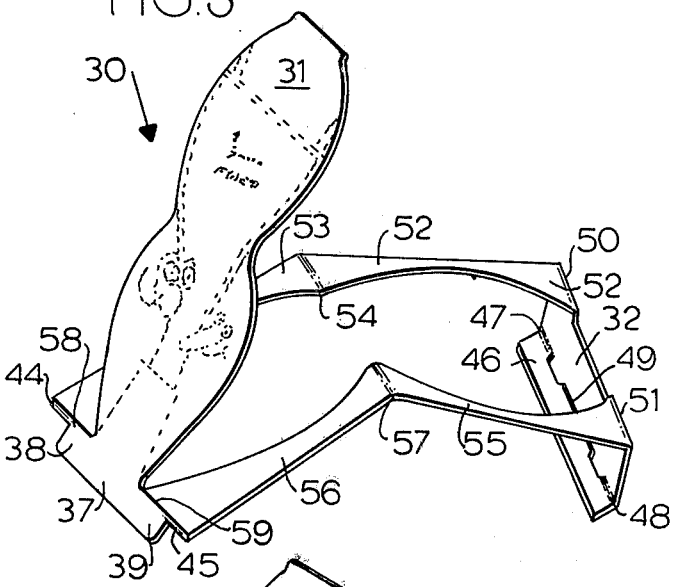
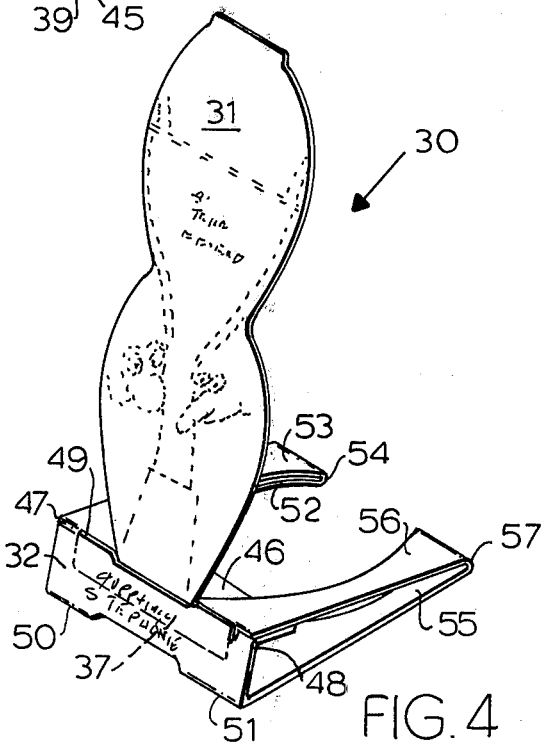
FIG. 4
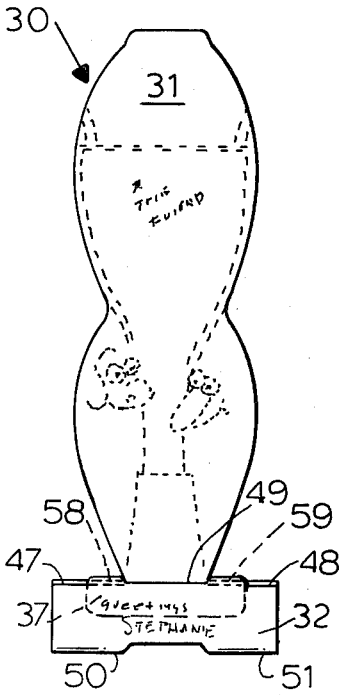
FIG. 5
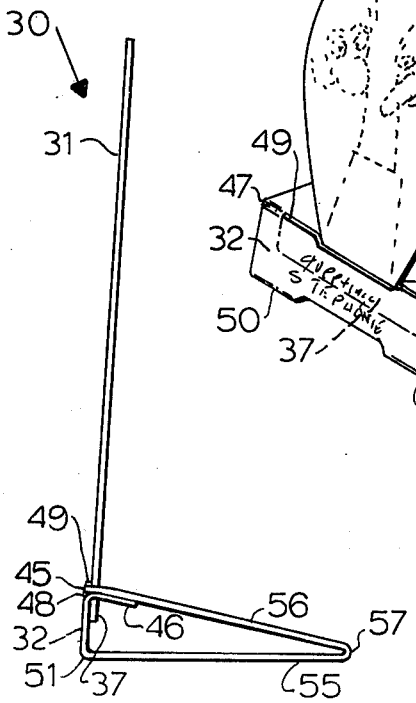
FIG. 6

FIG. 7
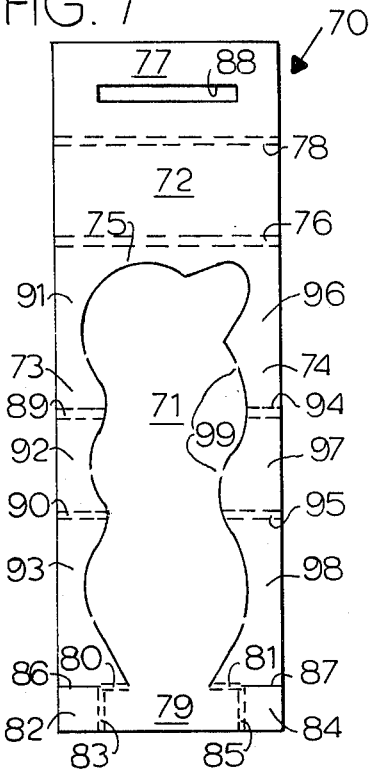
FIG. 8
FIG. 9
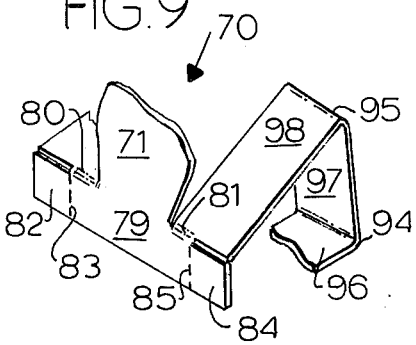
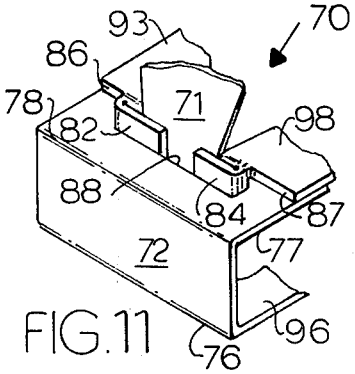
FIG. 11
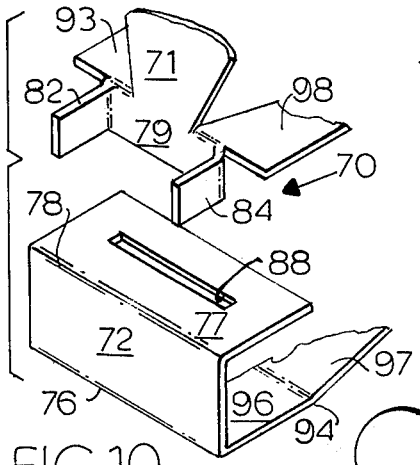
FIG. 10
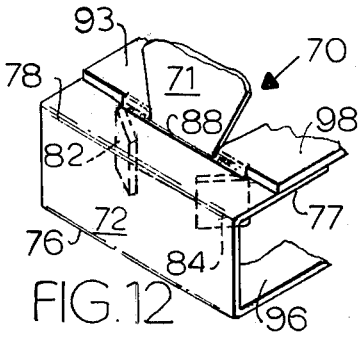
FIG. 12
FIG. 13
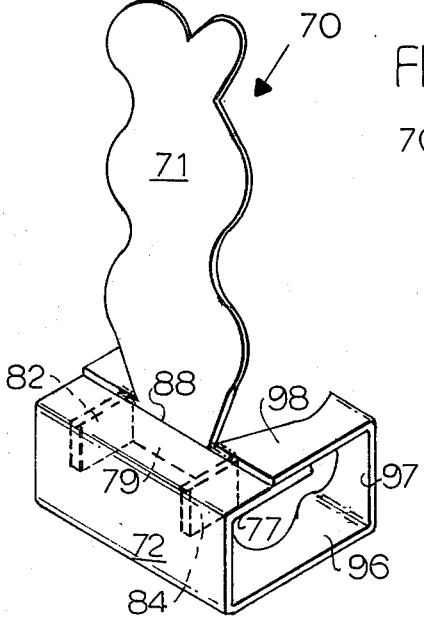
FIG. 14
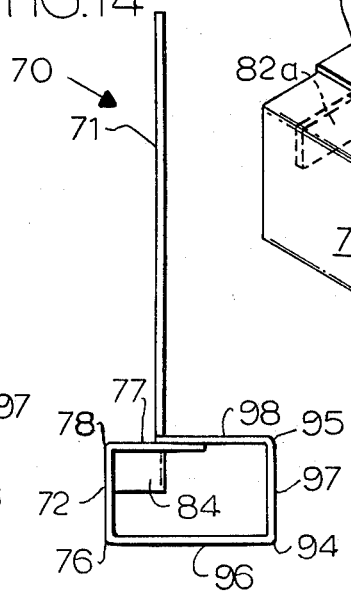
FIG. 15
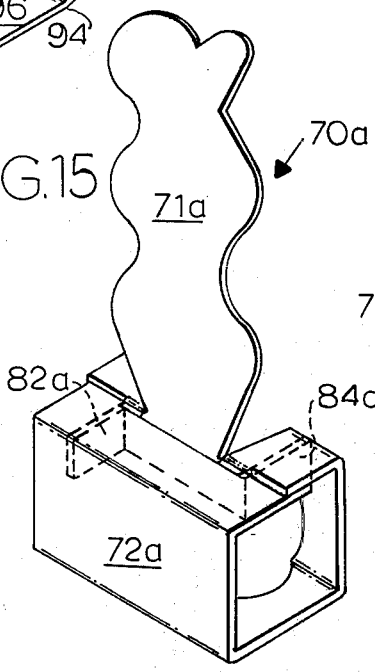
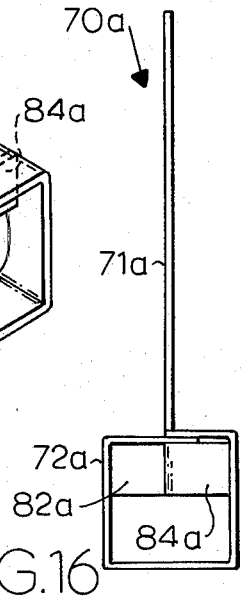
FIG. 16

FIG. 17
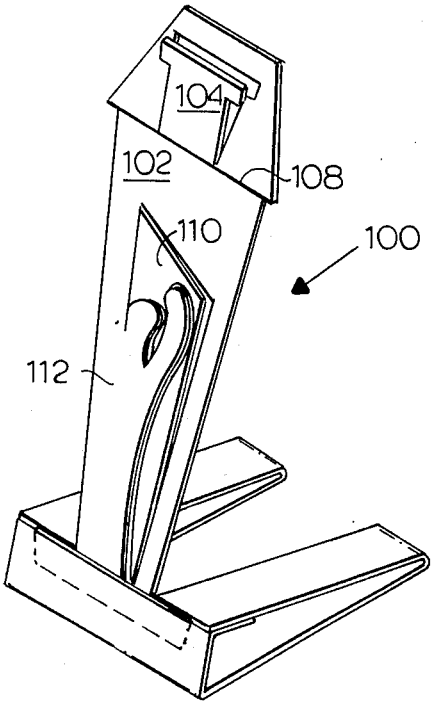
FIG. 18
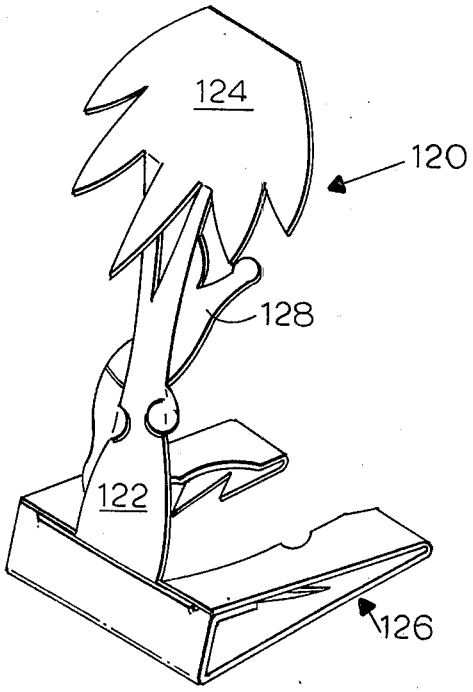
FIG. 19
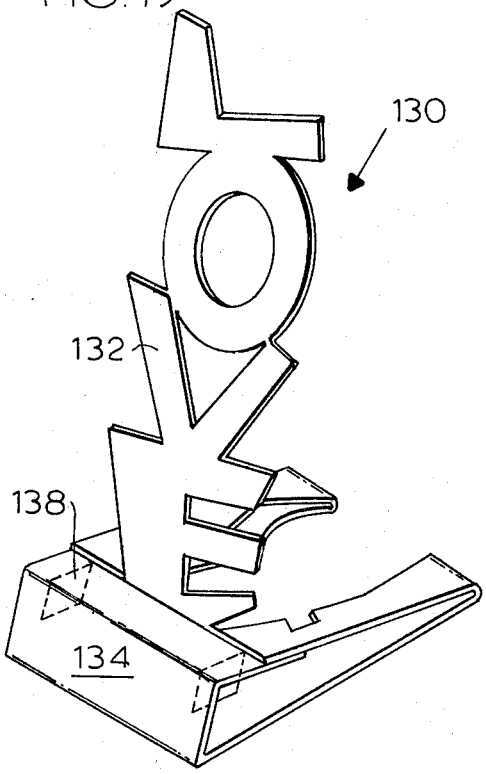
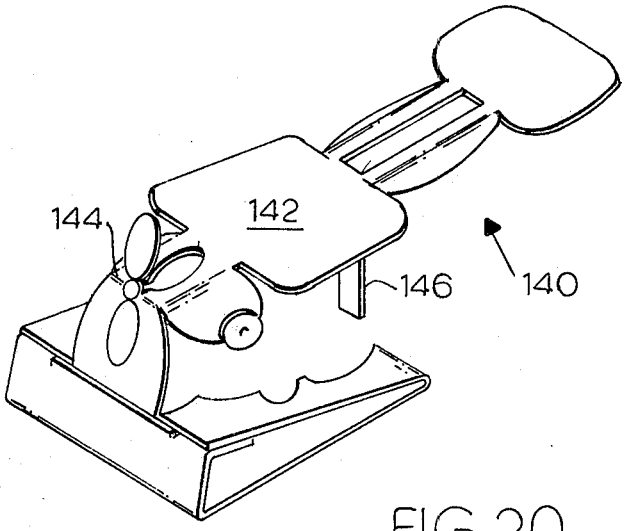
FIG. 20

FIG. 21
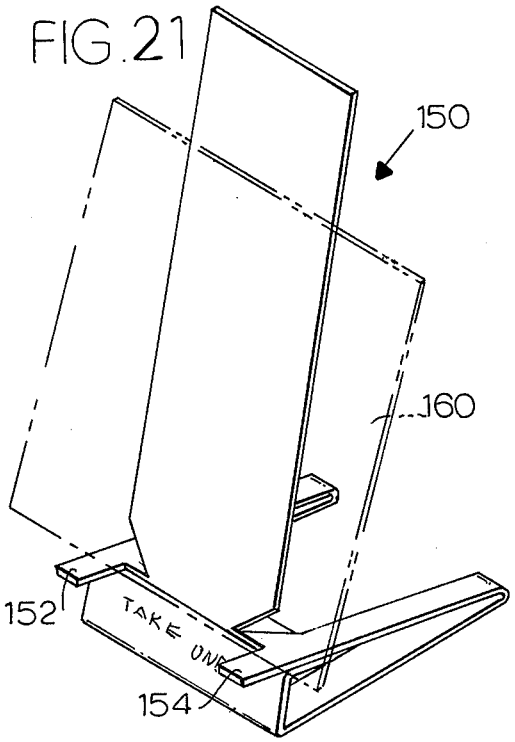
FIG. 22
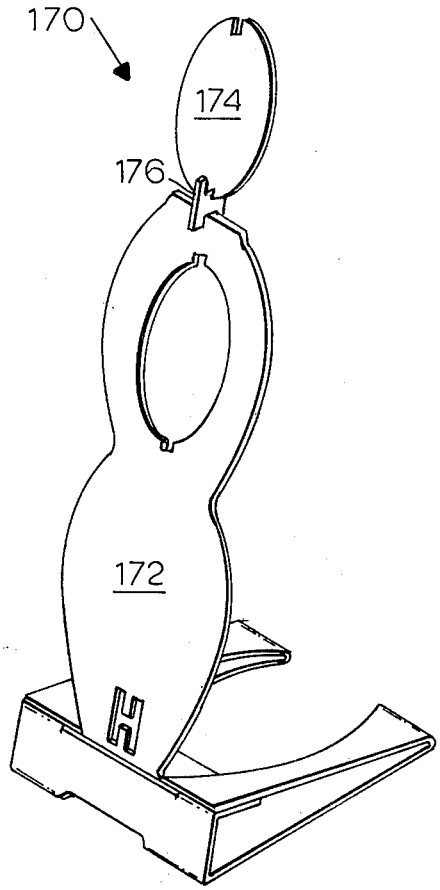
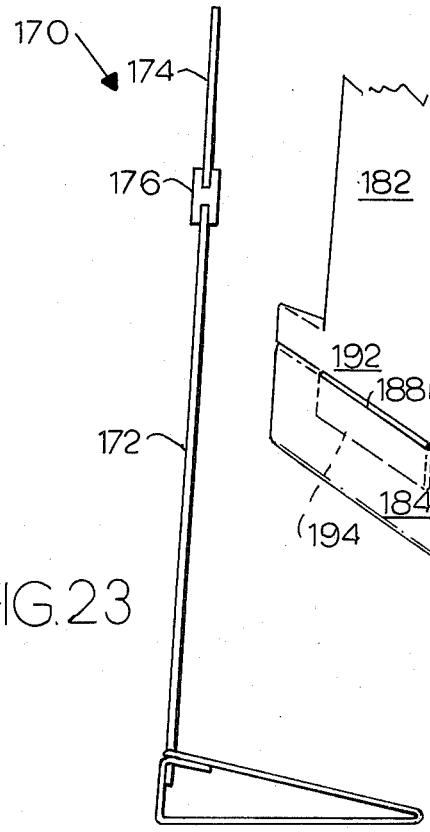
FIG. 23
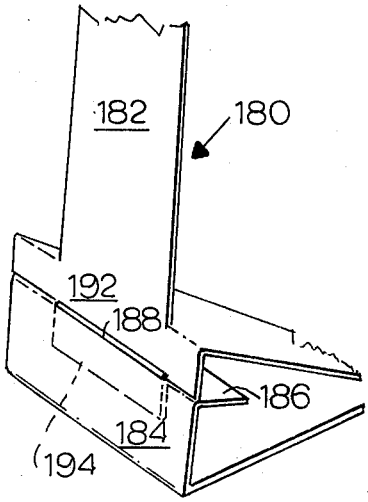
FIG. 25
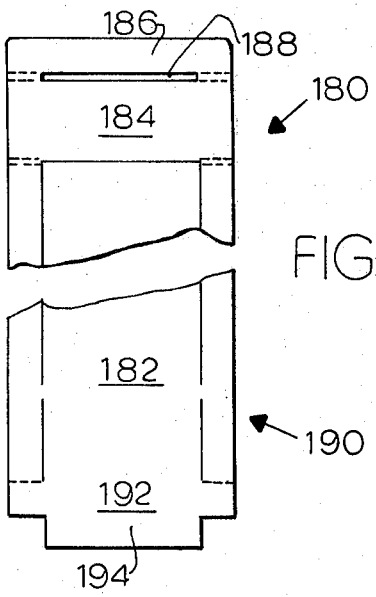
FIG. 24

CARD FORMING PEDESTAL DISPLAY DEVICE

BACKGROUND OF THE INVENTION

The present invention relates to a mailable card and more particularly to an improved mailable card formable upon receipt into one of a wide variety of self standing locked pedestal display easels and three dimensional devices.

Mailable postcards, greeting cards, display cards etc. which were formed by folding along designated lines into self standing easels have been known and used for many years. An early example of "personalized" mailable post cards was found in U.S. Pat. No. 1,208,391 to Simmonds. Therein, a picture or display portion was centrally positioned in the cards, an inverted U-shaped top portion of the card was separated from the picture portion by a die cut, enabling the top portion to be folded backward to provide a self standing easel for the picture portion. A personalization portion of the card carrying a name and/or salutation was located below the picture portion to provide a caption.

An example of a mailable display card device formable into a vertically standing internally braced prism was found in U.S. Pat. No. 2,407,592 to Walthen. Therein a sandwich of folded sheets was formable into the prism to provide a graphic display area on a major exposed surface thereof. The graphic display was entirely hidden from view while the device remained in the collapsed sandwich. Also, most of the card material was devoted to bracing and supporting the display surface which placed a premium upon the area thereof.

In recent years "personalized" mailable greeting cards displayed vertically in racks have enjoyed wide popular commercial acceptance. Such cards have characteristically included a name printed thereon and some form of salutation included in connection therewith e.g. "Greetings from BILL" or "Greetings to SUE". In practice such cards have been marketed in groups having a standard salutation with each card of the group bearing a different name and with the group sufficiently largs so that most common names were included, thus enabling selection of a desired name as well as salutation. Those cards have had the name printed at or near the top thereof, so that when the cards were placed in commercial display racks having tiers, at least the name on each outermost card would be plainly visible. Typically, the cards would be arranged so that the names were in alphabetical order. Thus, the shopper could rapidly locate the card having the desired name printed thereon. A drawback of such cards was that they were not formable into selfstanding display devices without incorporation of additional support elements. Another drawback of such cards was that the greeting and name appearing at the top of the card detracted from the underlying picture or display content. On the other hand the early post cards of the type described above as illustrated in U.S. Pat. No. 1,208,391 were not capable of display in tiered racks because the printed name was below the picture.

The foregoing and other limitations and drawbacks of prior art cards are overcome by the improved mailable card embodying the principles of the present invention, the objects and summary thereof now following.

SUMMARY OF THE INVENTION

An object of the present invention is to provide a single sheet card formable through predetermined cuts and fold lines into a self standing interlocked three dimensional pedestal display.

Another object of the present invention is to provide a single sheet card wherein interconnected top and side portions thereof after folding and assembly interlock to provide a supporting pedestal to hold the display portion of the card in an upright position.

A further object of the present invention is to provide an improved interlocking mechanism for locking formed single sheet cards into self standing pedestal base displays.

Yet another object of the present invention is to provide a single sheet card having a caption portion above a display portion while the card remains a single sheet and wherein the caption portion appears below the display portion after the card is formed into a self standing pedestal display.

A still further object of the present invention is to provide a single sheet card having a caption portion at the top thereof which remains viewable when the card is placed along with other similar cards in a display rack having multiple tier levels.

One other object of the present invention is to provide a single sheet card mailable as such which may be easily manipulated by the addressee into a predetermined self standing interlocked three dimensional pedestal display.

These and other objects and advantages of the present invention are accomplished by a single sheet card which may be formed into a self standing display having a pedestal base by manipulation of the card in accordance with a predetermined pattern therein of cuts and fold lines. The unassembled generally rectangular card includes a caption portion at the top which extends across the width thereof. A top tab is provided above the caption and is joined thereto along a first crease line. The top tab includes a continuous transverse slot which may be axially aligned along the first crease line or parallel thereto and spaced away therefrom. A display portion is centrally defined by a series of cuts in the card below the caption. Small spaced apart bridges may interrupt the series of cuts to maintain the card flat until assembly. Continuous left and right edge portions surround the display portion on both sides and are joined to the caption portion along a second transverse crease line. Each edge portion contains at least one transverse crease line dividing the portion into segments. A bottom tab is formed as a rigid extension of the display portion at the bottom thereof. The bottom tab was outwardly extending lateral portions, with a left portion joined to the left edge portion and a right portion joined to the right edge portion along a third transverse crease line.

The card is assembled into a three dimensional easel by rupturing the bridges if any and separating the portions of the card along the die cuts. Then the portions are folded along the crease lines so that the caption portion becomes transposed from the top of the unassembled card to the bottom of the display device. The bottom tab is then inserted through the slot above the caption portion to complete assembly of the device. If the slot is axially aligned with the first crease line, the insertion of the bottom tab through the slot provides the interlocked pedestal wherein opposed segments of the edge portions provide the feet of the pedestal base upon which the display rests. If the slot is axially displaced from the first crease line, then, tab extensions of the bottom tab are folded to brace the display portion relative to the pedestal. The tab extensions may also function to interlock the base pedestal.

Thus, the present invention enables a card to be formed into a locked pedestal display device wherein a top label portion of the card becomes a label portion of the pedestal.

BRIEF DESCRIPTION OF THE DRAWINGS

FIG. 1 is a front view in elevation of one preferred embodiment of a card embodying the principles of the present invention prior to assembly into a self standing triangular pedestal display.

FIG. 2 is a top edge view of the flat, unformed card illustrated in FIG. 1.

FIG. 3 is an isometric view of the card shown in FIG. 1 being formed into the pedestal display after the portions thereof have been separated along die cuts and folded backwards along fold lines.

FIG. 4 is an isometric view of the card shown in FIG. 1 after it has been formed into a self standing easel with a tab at the bottom of the picture shown in hidden view by broken line as being inserted through a slot at the top of the caption to lock the pedestal base and display portion in position.

FIG. 5 is a front view in elevation of the display shown in FIG. 4 with the tab shown in hidden view by broken lines.

FIG. 6 is a side view in elevation of the assembled display shown in FIG. 4.

FIG. 7 is a front view in elevation of another preferred embodiment of a card embodying the principles of the present invention prior to assembly into a self standing braced box pedestal display.

FIG 8 is a top edge view of the unformed card shown in FIG. 7.

FIG. 9 is an isometric view of a portion of the card of FIG. 7 during the initial separation and folding steps of assembly. The remainder of the card is deleted to save drawing space.

FIG. 10 is an isometric view of a portion of the card of FIG. 7 illustrating the positioning of the label portion thereof below the display portion with the tabs attached below the display portion folded toward the front.

FIG. 11 is an isometric view of a portion of the card of FIG. 7 showing the tabs folded against the display portion and the combination of the folded tabs and display portion partially inserted into a slot provided.

FIG. 12 is an isometric view of a portion of the card of FIG. 7 showing the display portion seated within the slot and the tabs (shown in hidden view by broken lines) folded part way toward the back side of the label portion.

FIG. 13 is an isometric view of the card of FIG. 7 assembled into a box pedestal with the tabs folded back to brace the display portion relative to the label portion.

FIG. 14 is a side view in elevation of the assembled braced box pedestal display shown in FIG. 7.

FIG. 15 is an isometric view of a card similar to the card shown in FIG. 7 assembled into a braced box pedestal display wherein the display portion and the slot are substantially centered relative to the pedestal and one of the tabs is folded to brace against the label portion whereas the other tab is oppositely folded to brace against a rear pedestal segment.

FIG. 16 is a side view in elevation of the assembled display shown in FIG. 15.

FIG. 17 is an isometric view of a self standing display formed from a card embodying the present invention into a three dimensional illusion of a home and a person waving from the doorway.

FIG. 18 is an isometric view of another display formed from a card embodying the present invention into a three dimensional illusion of a palm tree with a person waving from behind the trunk thereof.

FIG. 19 is an isometric view of a further display formed from a card embodying the present invention into a word message.

FIG. 20 is an isometric view of yet another easel formed from a card embodying the principles of the present invention into a three dimensional illusion of an airplane supported in a horizontal position by the easel base and by a leg member, an upper portion of which being shown in hidden view by broken lines.

FIG. 21 is an isometric view of another display formed from a card embodying the principles of the present invention providing an easel for holding cards or similar flat objects shown in phantom by broken lines.

FIG. 22 is an isometric view of still another display formed from a card embodying the principles of the present invention into a three dimensional illusion combining cutout portions of the picture area to gain additional height and depth.

FIG. 23 is a side view in elevation of the easel shown in FIG. 22.

FIG. 24 is a front view in elevation of a card formable into a modified locked triangular pedestal display with the central portion thereof broken and omitted to save drawing room.

FIG. 25 is a detail isometric view of the card shown in FIG. 24 with portions thereof broken away.

DETAILED DESCRIPTION OF PREFERRED EMBODIMENTS

Locked Triangular Pedestal Display

Referring first to FIGS. 1 and 2, a mailable card 30 embodying the principles of the present invention includes a picture in the central display portion 31 thereof which is surrounded by a caption portion 32 at the top, a left edge portion 33 and a right edge portion 34 all separated from the picture display 31 by a discontinuous die cut 35, the discontinuities therein providing several spaced apart bridges 36 which function to hold the card intact as a single sheet during mail handling and delivery and which are easily torn to enable folding and assembly of the card 20 to form a pedestal display, as shown in FIG. 4.

At the base of the picture display 31 is a bottom tab 37 which is formed as a rigid extension thereof. The tab 37 includes a left lateral extension 38 and a right lateral extension 39. Lower corner cutouts 40 and 41 are joined to the left edge portion 33 and left extension 38 and right edge portion 34 and the right extension 39 respectively by small bridges 42 and 43 dividing die cuts 44 and 45 in the manner and for the reasons explained in connection with the bridges 36 and die cuts 35.

At the top of the caption 32 is a top tab 46 which is joined thereto by two folds 47 and 48, interrupted by an axially aligned die cut 49 which is sized and shaped as to provide a gap after folding of the card 30 for receiving the bottom tab 37 therethrough. The caption 32 is joined to the left edge portion 33 and to the right edge portion 34 by two spaced apart folds 50 and 51, interrupted by a top portion of the die cut 35. There is, however, no requirement that the folds 50 and 51 be interrupted by the die cut, and the connection of the caption portion 32 to the edge portions 33 and 34 may be by a single transverse fold.

The left edge portion 33 is bisected into two generally equal segments, an upper segment 52 and a lower segment 53 by a transverse fold line 54; and, the right edge portion 34 is similarly bisected into an upper portion 55 and a lower portion 56 by a transverse fold line 57 which is axially aligned with the fold line 54.

The lower segment 53 of the left edge portion 33 is joined to the left lateral extension 38 of the tab 37 along a fold line 58; and, the lower segment 56 of the right edge portion 34 is likewise joined to the right lateral extension 39 of the tab 37 along a fold line 59 which is aligned axially with the fold line 58.

Referring now to FIGS. 3–6, the card 30 is formed into a three dimensional triangular pedestal display by first separating the picture portion 31 from the caption portion 32, left edge portion 33, and right edge portion 34 by breaking the bridges 36 and bending the caption portion 32 backward along folds 58 and 59. The top tab 46 is bent backwardly along folds 47 and 48 so that a gap is formed by the die cut 49. The caption portion is then bent back along the folds 50 and 51 and the upper segments 52 and 55 are then bent backwardly together along the folds 54 and 57 to create the object illustrated in FIG. 3.

To complete assembly, the caption portion 32 is bent all the way around to a position below and in front of the picture 31; the tab 37 is then inserted through the gap formed by the die cut 49 to provide the triangular pedestal display shown in FIGS. 4–6. The lower corner cutouts 40 and 42 may be removed or they may remain to provide e.g. an easel (as shown in FIG. 11, discussed hereinafter) depending upon the purpose for which the display-forming card 20 is to be used.

Braced Box Pedestal Display

A second preferred embodiment incorporating the principles of the present invention is to be found in the card 70 illustrated in FIGS. 7–14. The unformed card 70 shown in FIG. 7. and FIG. 8 includes a display portion 71, a label portion 72 above the display portion 71, a left side portion 73 and a right side portion 74 joined together by a top segment 75, which is connected to the label portion 72 along a transverse fold line 76, a top tab 77 joined to the label portion 72 along a transverse fold line 78, and a bottom tab 79 below and constituting an extension of the display portion 71. The side portions 73 and 74 are joined to the bottom tab 79 by folds 80 and 81, respectively.

The bottom tab 79 includes a left tab 82 joined thereto along a longitudinal fold 83 and a right tab 84 joined thereto along a fold 85. The tabs 82 and 84 are separated from the left side 73 and right side 74 portions by die cuts 86 and 87 respectively.

The top tab 77 includes a transverse gap 88 which has a length sufficient to receive therethrough the bottom tab 79 and a width sufficient to receive two thicknesses of card stock forming the card 70, the two thickness width being required when the left and right tabs 82 and 84 are folded back against the bottom tab 79 as best shown in the detail view of FIG. 11.

The left side portion 73 includes two spaced apart transverse folds 89 and 90 to divide the left portion 73 into three segments 91, 92 and 93. The right side portion 74 similarly includes two folds 94 and 95 which divide the right portion 74 into three segments 96, 97 and 98.

Formation of the card 70 into a box pedestal display is illustrated by the detail FIGS. 9–12. The display portion 71 is separated from the left side 73, right side 74 and top segment 75 along a die cut 99. The top tab 77 is folded backward along the fold 78. The label portion 72 is then folded back along the fold 76. The segments 91 and 96 are folded back at the folds 89 and 94, and the segments 92 and 97 are folded back at the folds 90 and 95. Finally the segments 93 and 98 are folded back along the folds 80 and 81, and the left and right tabs 82 and 84 are folded to the front along folds 83 and 85, as shown in FIGS. 9 and 10.

The left and right tabs 82 and 84 are then folded flatly against the bottom tab 79 which is thereupon inserted through the slot 88, as best shown in FIG. 11. After the bottom tab 79 has passed completely through the gap 88, the left and right tabs 82 and 84 are bent toward the back major surface of the label portion 72, as shown in FIG. 12.

As seen in FIGS. 13 and 14, the length of the left and right tabs 82 and 84 corresponds to the distance separating the gap 88 from the adjacent fold line 76. Thus, the tabs 82 and 84, when bent into contact against the back of the label portion 72, lock the display portion 71 in a vertical position relative to the supporting box pedestal.

A locked box pedestal display may be provided by slightly modifying the card 70 illustrated in FIGS. 7–14. In FIGS. 15 and 16 a slightly different card **70*a* includes longer left and right tabs 82*a* and 84*a* and a gap 88*a* which after folding is substantially centered in the pedestal. The left tab 82*a* is e.g. folded to the front to lock the label panel 72*a* and top tab 77*a* at right angles, and the right tab 84*a* is folded to the back to lock the segments 98*a* and 97*a* at right angles. At the same time, by aligning tabs 82*a* and 84*a* oppositely, the display panel 71*a* is securely locked in a vertical position. Thus, the display panel 71*a*** would be suited to pictorial display on both sides, if that were desired.

It is to be understood that the cards 30 and 70 may provide on one side a printed caption within the caption or label portion and a printed reproduction in the picture or display portion. On the opposite side of the card would be designated locations for address and postage, a personal message and assembly instructions enabling formation of the card into a three dimensional pedestal display. Or, in the alternative, as illustrated by the card **70*a***, pictorial display material could be placed on both sides of the label or display portion.

Preferably, each side of the card would be separately printed on conventional 50–60 pound thin coated paper stock and then laminated to 50 to 70 point chipboard. I prefer to utilize 55 point chipboard which provides a 1 ounce card having edge dimensions of 4 inches by 12 inches. A 1 ounce card provides a particularly advantageous mailer under existing domestic postal rates.

A variety of possible designs for cards following the principles of the present invention is exemplified in FIGS. 17–23.

In FIG. 17, a card 100 is formed into a locked triangle pedestal display of a house 102 having a chimney 104 and a roof 106 bent back therefrom along a fold line 108. A door illusion 110 appears behind the silhouette of a person 112 shown waving from a doorway.

In FIG. 18 a card 120 is formed into a palm tree having a trunk 122 and palm leaves 124 bent forwardly and held vertically by a triangle pedestal 126. A human form 128 is shown climbing the tree trunk 122 and waving.

FIG. 19 depicts a card 130 formed into a word message 132 above a caption 134. The base 136 is a combination of features of the two preferred embodiments described hereinabove and includes a ledge 138 which offsets the caption 134 from the message 132.

FIG. 20 shows a card 140 formed into a horizontally disposed airplane 142 which is folded backwardly along a fold line 144. With bent over illusions, such as the airplane 142, it may be advantageous to include a vertical foot 146 which is hinged to, e.g., the airplane 142 to support it in the intended horizontal position.

FIG. 21 illustrates a card 150 formed into an easel wherein the lower corners 152 and 154 have remained rigidly connected to the left and right segments 156 and 158 to provide supports for holding cards, photographs etc., 160 shown in phantom by broken lines. The card 140 is particularly well suited to the display of commercial and advertising matter.

FIGS. 22 and 23 illustrate a card 170 formed into a pedestal display wherein a picture portion 172 includes multiple cutouts 174 and 176 which may be cooperatively fitted together and to the picture 172 to add the illusion of height and depth to the display.

A modified locked triangular pedestal display card 180 is illustrated in FIGS. 24 and 25. Therein, the card 180 includes a display panel 182, upper caption panel 184, to tab 186 and slot 188. A bottom section 190 includes a lower caption panel 192 and a bottom tab 194. As shown in FIG. 25, the card is formed into a locked triangular pedestal display in the manner described hereinabove in which the lower caption panel 192 appears immediately above the upper caption panel 184.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A four sided single sheet card formable into pedestal supporting display comprising a single thickness of sheet material of suitable shape to provide said card, said sheet material having a predetermined pattern of cuts and fold lines for defining:

a. a top portion of said card including a label section and a top tab, said label section being joined to said top tab along a first transverse fold line;

b. opening means for providing a transverse opening within said top portion of said card;

c. a left section connected to said top portion along a second transverse fold line, said left section extending downwardly therefrom along the left edge of said card and having left transverse crease lines means for dividing said left section into at least two vertically arranged segments;

d. a right section connected to said top portion, said second fold line, said right section extending downwardly therefrom along the right edge of said card and having right transverse crease line means for dividing said right section into at least two vertically arranged segments each of which substantially corresponds to a similarly located segment of said left section;

e. a display section between said left and right sections and below said top portion of said card and severable from said top portion, said left section and said right section;

f. a bottom portion of said card at the bottom of said display section and rigidly integral therewith, said bottom portion having a bottom tab and left and right lateral portions extending beyond said display section, said left portion being joined along a third fold line to said left section, said right portion being joined along said third fold line to said right section along an eighth crease line, whereby said card may be formed into said pedestal supported display by detachment of said display portion, outward folds along all said crease lines, placement of said label section adjacently below said display section to form said display and insertion of said bottom tab through said opening means to interlock said pedestal.

2. A display forming card of claim 1 wherein said left transverse crease line means and said right transverse crease line means comprise a single transverse fold line positioned to divide said left and said right section each into two segments of substantially equal longitudinal length to define said pedestal as a locked triangular assembly.

3. The display forming card of claim 1 wherein said left transverse crease line means and said right transverse crease line means comprise a single fold line for dividing said left section and said right section each into two segments of unequal length wherein the top segments of said left and right section are equal in length and longer than the bottom segments thereof, and wherein said opening means in said top portion is located in said top tab at a predetermined offset from said label section so that said card defines a pedestal including a ledge portion which offsets said label section forwardly of said display section.

4. The display forming card of claim 1 wherein said left transverse crease line means and said right transverse crease line means comprise two parallel transverse spaced apart fold lines for dividing said left section and said right section each into three segments to enable said card to be formed into a box type of pedestal.

5. The display forming card of claim 4 wherein said opening means is located in said top tab spaced away from said label section and said left and right lateral portions of said bottom portion include left and right tabs joined thereto along vertical fold lines, the length of said tabs from said fold being related to the distance said opening means is offset from said label section.

6. The display forming card of claim 5 wherein said left and right tabs are foldable to brace against the inside major surface of said label section.

7. The display forming card of claim 5 wherein one of said left and right tabs is adapted to brace against the inside major surface of said label section and the other of said left and right tabs is adapted to brace against joined adjacent segments of said left section or seid right section.

8. The display forming card of claim 5 wherein said opening means is offset from said label section to a position so that when said box pedestal is formed by folding, said opening means is located substantially equidistant from said label section and a back of said pedestal.

9. The display forming card of claim 1 wherein said left section includes a left extension at the base thereof which is severed from said bottom tab so that when said card is formed into said pedestal display, said extensions may support objects placed upon said display and thereby render it an easel.

10. The display forming card of claim 1 wherein said display section includes connected portions adapted to be folded and bent to provide a three dimensional illusion.

11. The display forming card of claim 1 wherein said display section includes transverse folds enabling said display section to be folded over into horizontal alignment.

12. The display forming card of claim 1 comprising additionally supporting means within said display section for supporting said display in a predetermined horizontal alignment.

13. The display forming card of claim 1 including within said display section cutout portions.

14. The display forming card of claim 13 wherein said cutout portions are attachable to said formed card to provide additional height and depth illusions to the display.

* * * * *